US010677263B2

(12) United States Patent
Ng

(10) Patent No.: US 10,677,263 B2
(45) Date of Patent: Jun. 9, 2020

(54) ATTACHABLE PERSONAL COOLING FANS

(71) Applicant: Richard Ng, Phoenixville, PA (US)

(72) Inventor: Richard Ng, Phoenixville, PA (US)

(73) Assignee: Richard Ng, Phoenixville, PA (US)

( * ) Notice: Subject to any disclaimer, the term of this patent is extended or adjusted under 35 U.S.C. 154(b) by 209 days.

(21) Appl. No.: 15/976,961

(22) Filed: May 11, 2018

(65) Prior Publication Data

US 2019/0345957 A1 Nov. 14, 2019

(51) Int. Cl.

| | |
|---|---|
| ***A42B 1/00*** | (2006.01) |
| ***F04D 29/60*** | (2006.01) |
| ***F04D 25/06*** | (2006.01) |
| ***F04D 25/16*** | (2006.01) |
| ***A63B 71/10*** | (2006.01) |
| *F04D 17/16* | (2006.01) |
| *F04D 19/00* | (2006.01) |

(52) U.S. Cl.

CPC ..... *F04D 29/601* (2013.01); *A42B 1/008* (2013.01); *A63B 71/10* (2013.01); *F04D 25/0673* (2013.01); *F04D 25/166* (2013.01); *F04D 17/16* (2013.01); *F04D 19/002* (2013.01)

(58) Field of Classification Search

CPC .. A42B 1/008; A42B 1/24; A42B 3/20; A42B 3/286; A63B 71/10; F04D 25/084; A42C 5/04

See application file for complete search history.

(56) References Cited

U.S. PATENT DOCUMENTS

| | | | | |
|---|---|---|---|---|
| 7,000,841 | B2 * | 2/2006 | Becker | A42B 1/244 235/462.42 |
| 9,392,832 | B2 * | 7/2016 | Lombard | A42B 3/044 |
| 9,486,026 | B1 * | 11/2016 | Cook, Sr. | A42B 1/24 |
| 10,278,442 | B2 * | 5/2019 | Wang | F04D 25/0673 |
| 2010/0012692 | A1 * | 1/2010 | Harris | A42B 3/04 224/181 |
| 2018/0283622 | A1 * | 10/2018 | Weyand | F21V 23/0407 |

FOREIGN PATENT DOCUMENTS

| | | | | |
|---|---|---|---|---|
| EP | 2186552 | A1 * | 5/2010 | A41D 13/0025 |

OTHER PUBLICATIONS

YouTube video titled "DIY: How to instal paintball goggle/mask fans" by Megatron Paintball HD and published on Nov. 2, 2011.*
YouTube video titled "paintball mask fan kit review" by be4thebattle and published on Nov. 12, 2013.*
YouTube video titled "Vs. | Zip Ties vs. Visor Clips" by Lineman Football and published on Mar. 24, 2015.*
YouTube video titled "Action Fans Cyclone Mike Common Installation Tips actionfans.net" by ACTIONFANSdotNET and published on Dec. 7, 2011.*

* cited by examiner

*Primary Examiner* — Blake A Tankersley

(57) ABSTRACT

This invention relates to attachable personal cooling fans specifically designed to provide several hours of cooling for the user. These units were originally designed for baseball/softball plate and base umpires for hot weather conditions, however, they could be adapted for other uses. The units are portable and lightweight and can be attached to any face-mask or cap.

1 Claim, 6 Drawing Sheets

ATTACHABLE PERSONAL COOLING FANS

BACKGROUND OF THE INVENTION

Figure 1:
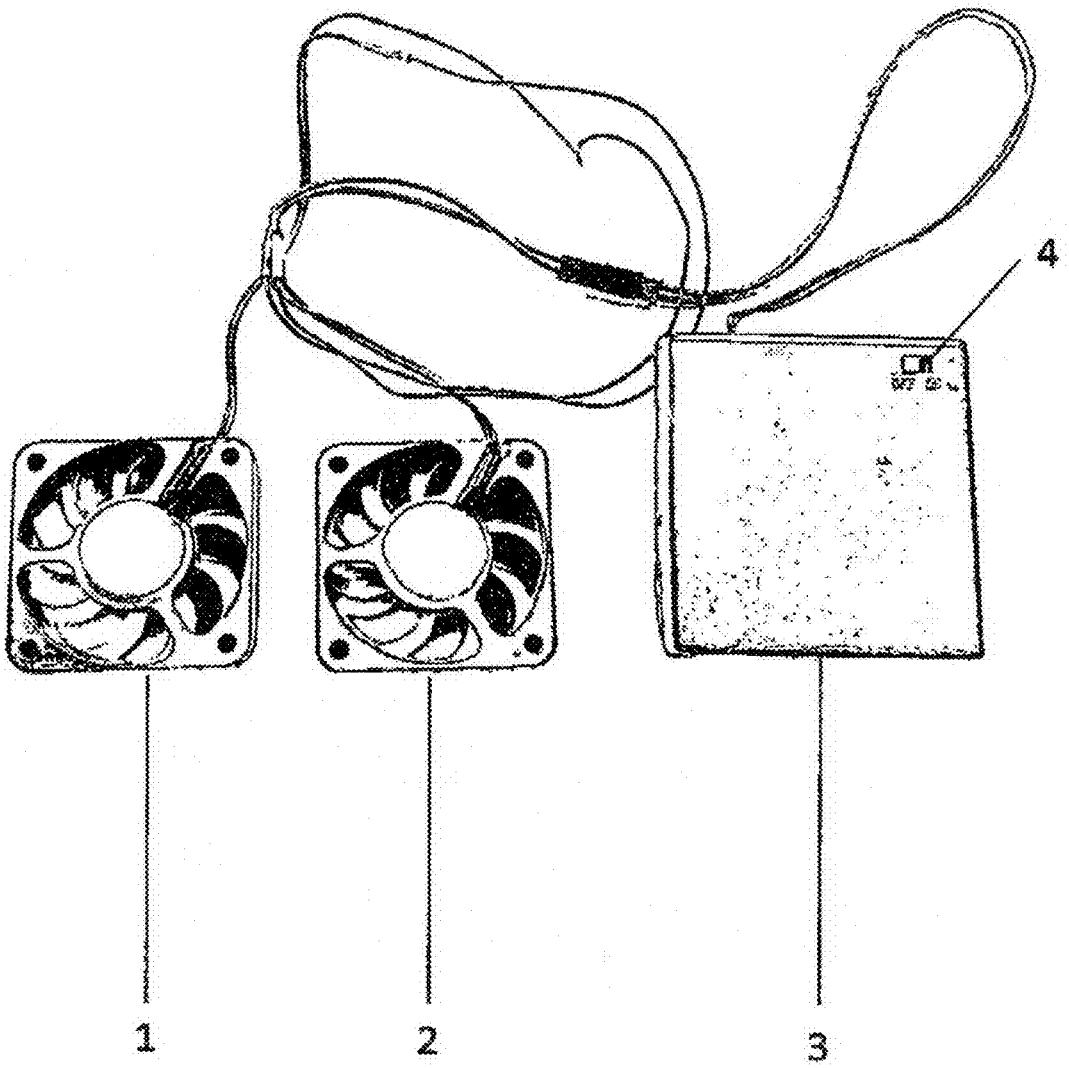

Umpiring baseball and softball games requires that umpires remain cool, calm and collected to make the right calls and deal with the players, coaches and fans. The task becomes even more difficult when the weather is hot and humid.

Umpiring the plate is extremely exhausting because of the protective gear underneath and the facemask on the face. The base umpire does not wear the protective gear but must on the move with the base runners. Professional umpires may only do one or two games a day, however, the recreational umpire who does tournaments may do six games in a day.

In hot and humid summer weather, there is a high potential for heat related illness. It is necessary for the umpires to stay cool. There are devices and methods to keep the umpires cool such as placing ice inside the chest protector, wet cold rags around the neck, ice cubes inside your hat, etc. All these devices and methods do not provide a long lasting cooling effect and can be messy.

Cooling the head offers a very effective method to prevent heat related illnesses. The cooling unit for the plate umpire is attached to the facemask. It is located behind the cage of the facemask where it is protected from any balls hitting the facemask. The unit for the base umpire is located underneath the brim of the cap where it is fairly unnoticeable and provides full visibility for the umpire. This unit is clipped on and can be easily detached and placed on another cap (each league has its own dress caps).

The attachable units include 5V, 0.14-0.15 A fans powered by AA or AAA batteries. The batteries may be single use or rechargeable. Any type of battery capable of supplying the required power to the fans will work. Tests show that the fans run continuously for 8 hours using four AA batteries and about 4 hours using four AAA batteries. Button batteries which supply the power will not last long. There is no need for a detached battery power pack with umbilical cord.

Presently, there are no devices on the market to provide this type of cooling for the umpires.

BRIEF SUMMARY OF INVENTION

The invention is an attachable personal cooling fan unit that can be attached to any 1) facemask and 2) cap to provide cooling for the user. The units were originally designed for baseball and softball umpires, but can be applied to any head gear for cooling purposes.

The attachable units include 5V fans powered by AA or AAA batteries. The batteries may be single use or rechargeable. Any type of battery capable of supplying the required power to the fans will work. Tests show that the fans run continuously for 8 hours using four AA batteries and about 4 hours using four AAA batteries. Button batteries that supply the power will not last long. There is no need for a detached battery power pack with umbilical cord.

The advantages of these units include:

1. Can be attached to any type of facemask.
2. Can be attached to any cap,
3. Provide cooling to the user for up to 8 hours.
4. Are not very noticeable.
5. Do not hinder visibility.
6. No umbilical cord to power source.
7. Lightweight
8. Easily attached and removed 9. Quiet
10. Transferable to any cap, hat or head gear.

Presently, there are no devices on the market to provide this type of cooling for the umpires.

BRIEF DESCRIPTION

FIG. 1: Front view of attachable cooling fans (two) and battery pack (1) for face mask.

Two 50 mm 5V fans wired to a battery case holding 4 AA batteries.

Figure 2:
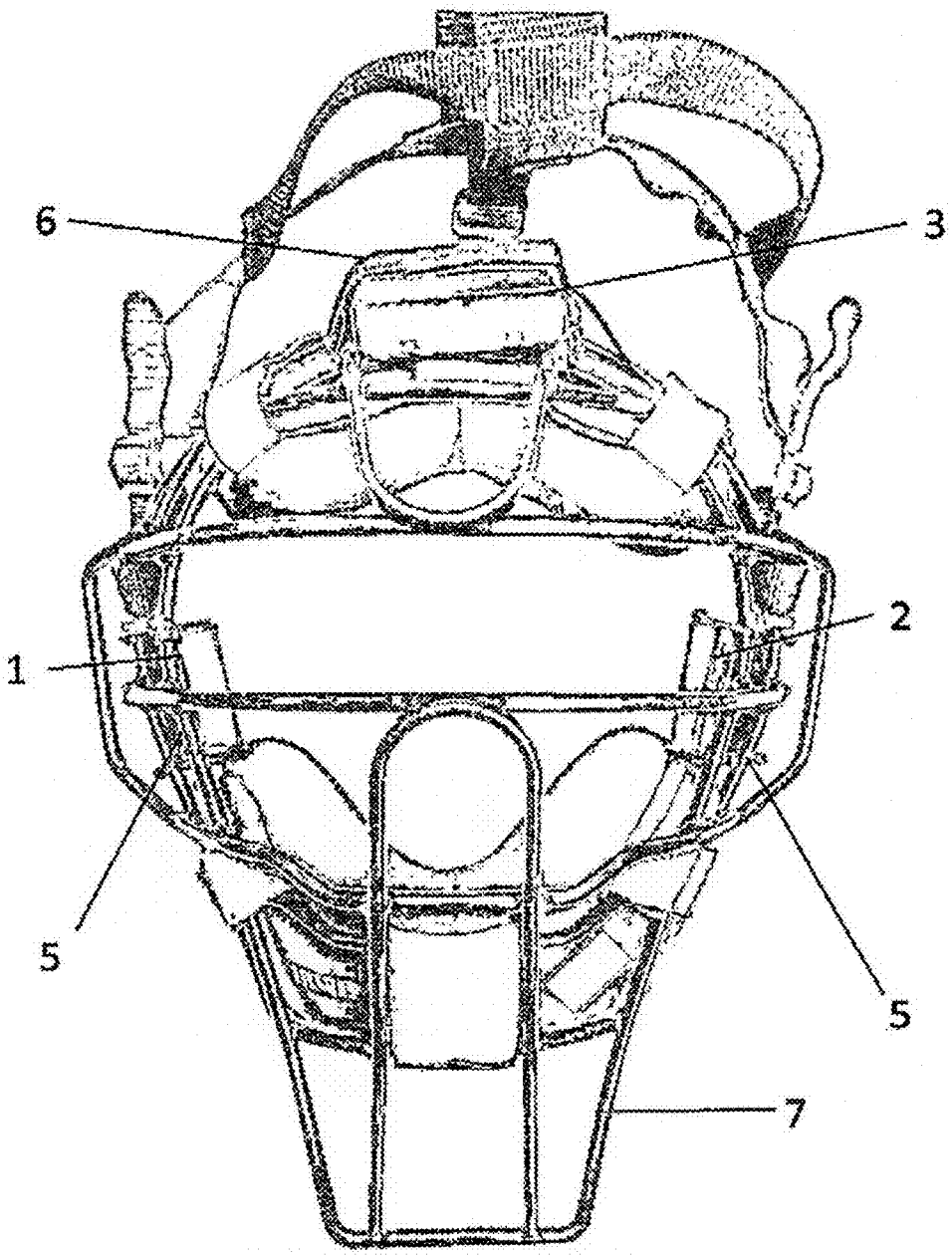

FIG. 2: Front view of attachable cooling fans and battery pack attached to the face mask.

The fans are attached with zip ties to the frame on the sides.

The battery pack is attached with a Velcro strip to frame on top.

The wires are taped to the frame with electrical tape.

Figure 3:
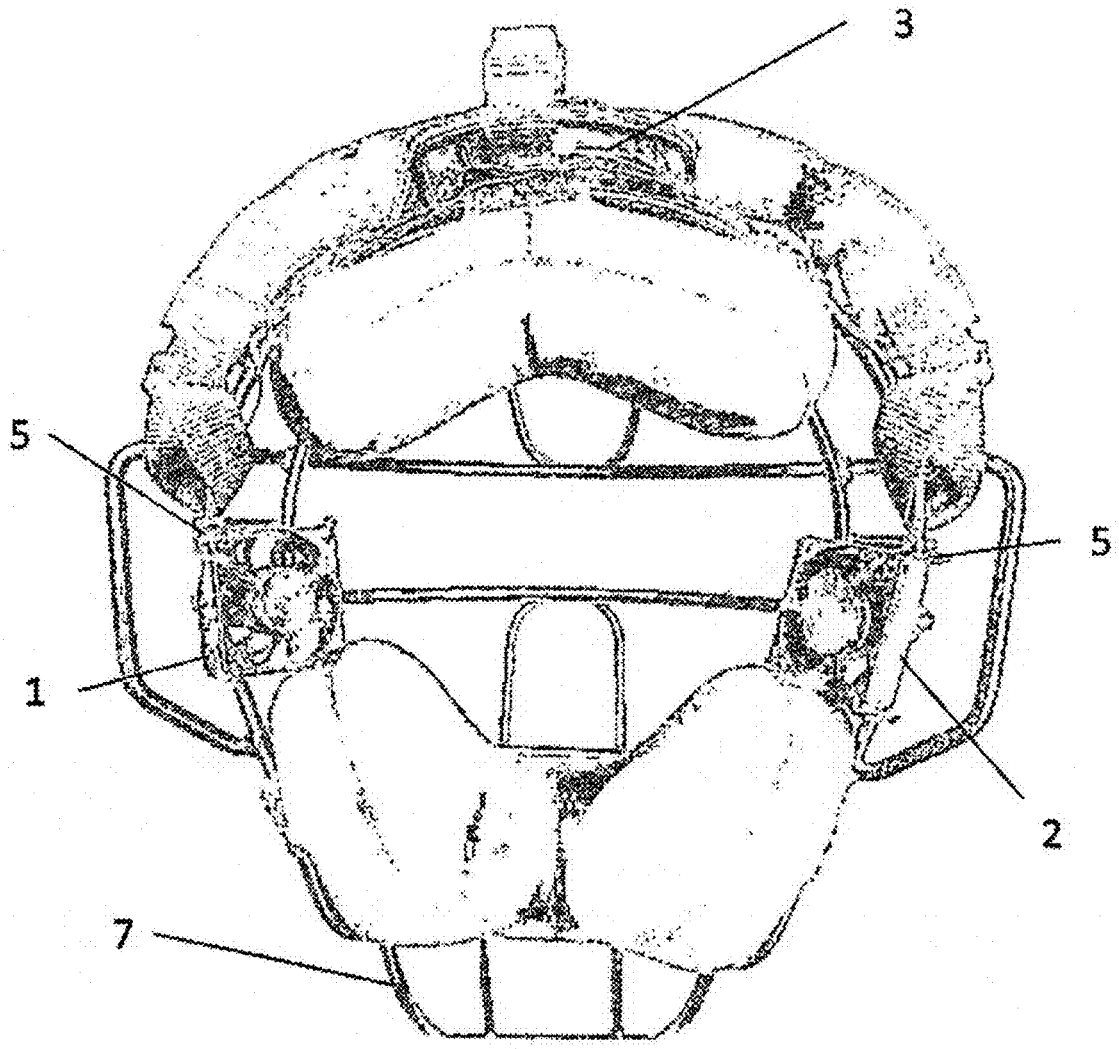

FIG. 3: Back view of attachable cooling fans and battery pack for face mask.

Figure 4:
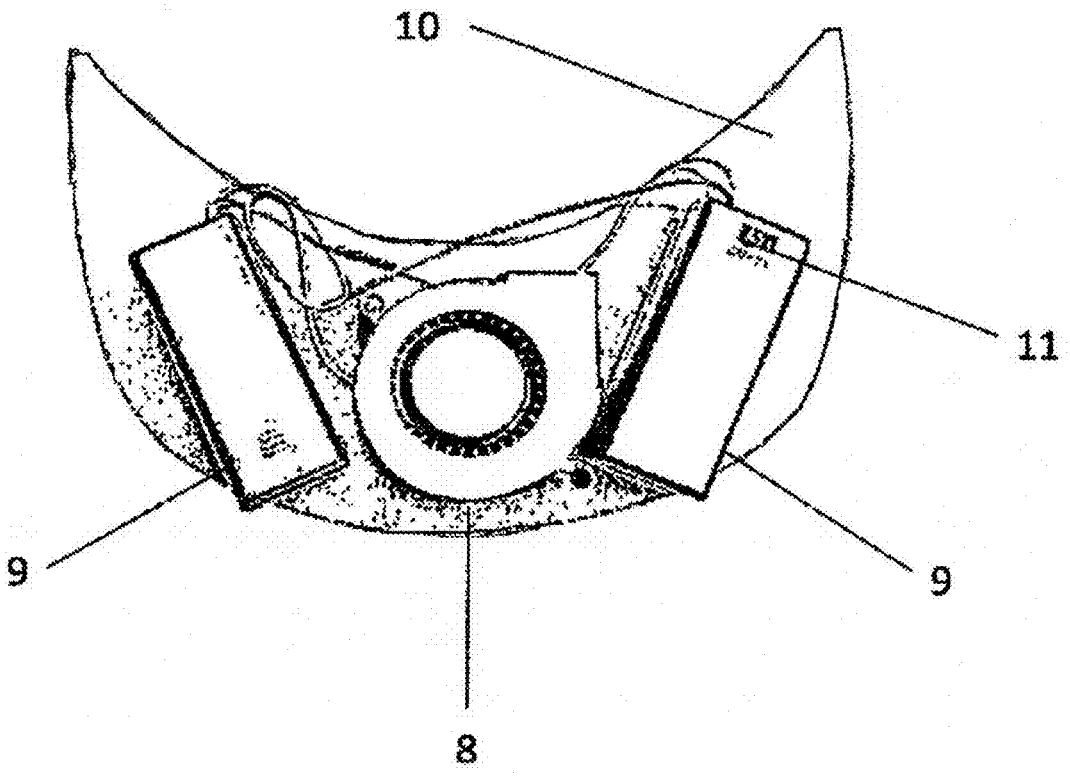

FIG. 4: Top view of the attachable cooling fan unit for a cap.

One cooling fan and two AAA battery cases attached to a laminated cardboard backing with Velcro.

Figure 5:
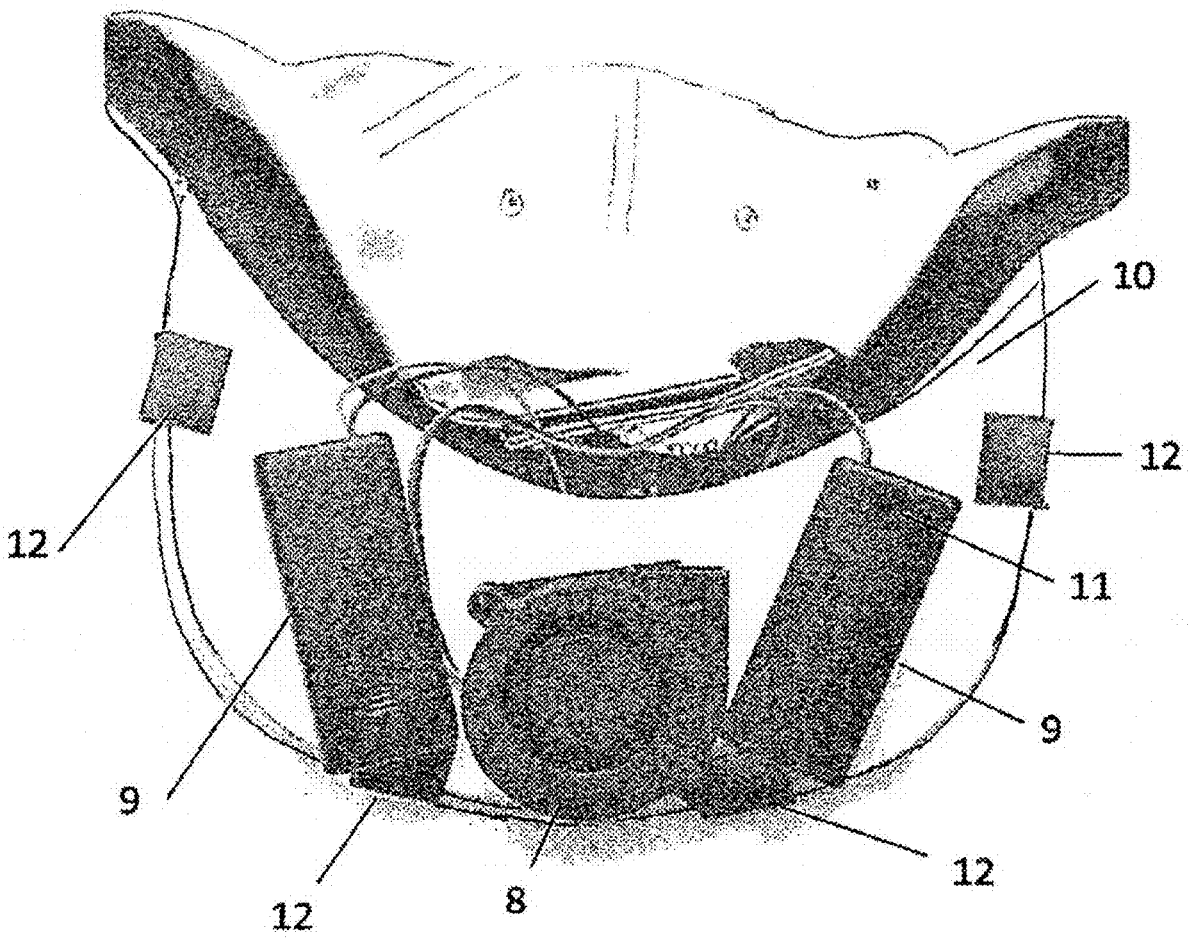

FIG. 5: Back view of the attachable cooling fan unit attached to brim of cap with dips.

Figure 6:
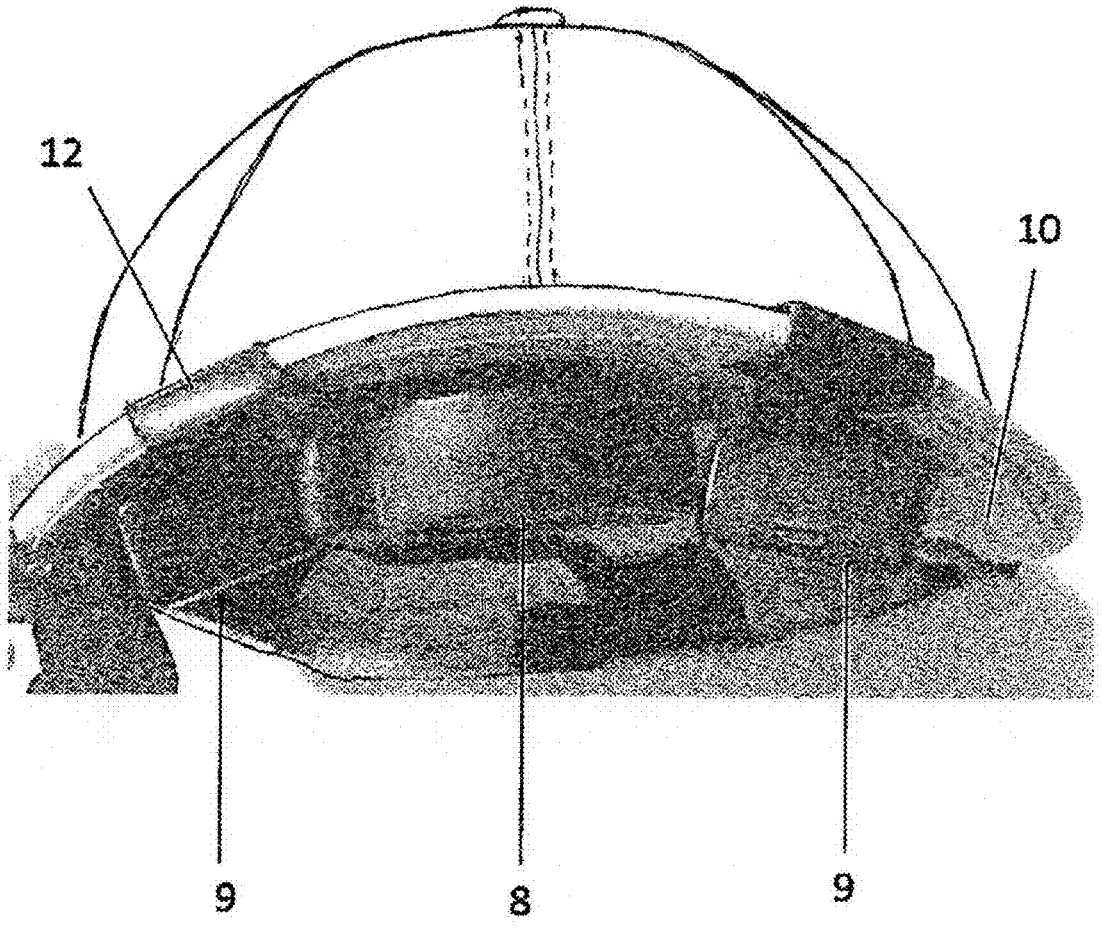

FIG. 6: Front view of the attachable cooling fan unit on a cap.

DETAILED DESCRIPTION

FIG. 1: Front view of attachable cooling fans 1,2 and battery pack 3 for face mark.

Two 50 mm 5V fans 1,2 wired to a battery pack holding 4 AA batteries 3.

There is an on/off switch 4 on the battery 3.

FIG. 2: Front view of the attachable cooling fans 1,2 and battery pack 3 attached to the face mask 7.

The fans are attached with zip ties 5 to the frame on the sides.

The battery pack 3 is attached with a Velcro strip 6 to frame on top 7.

FIG. 3: Back view of attachable cooling fans 1-2 and battery pack 3 for face mask 7.

FIG. 4: Top view of the attachable cooling fan unit for a cap.

One cooling fan 8 and two AAA battery packs 9 are attached to a laminated cardboard backing 10 with Velcro.

There is an on/off switch 11 on the battery 9.

FIG. 5: Back view of the attachable cooling fan unit attached underneath to the brim of a cap with clips.

The unit in FIG. 4 is attached to the brim of a cap by clips 12.

FIG. 6: Front view of the attachable cooling fan unit on a cap.

The unit fits underneath any cap and is not noticeable to the wearer.

The invention claimed is:

1. An unpire facemask comprising:

a frame comprising a plurality of bars with space in between the bars which allows the umpire to see but prevents balls from penetrating the facemask;

padding attached to an inside of the frame and configured to be placed between the frame and the umpire's face to absorb impact from a ball striking the facemask;

fans attached to the inside of the frame and located on left and right sides of the frame, respectively, in order to minimize obstructions to the umpire's view and to prevent a ball from directly striking the fans; and a battery pack that is attached to an outside of the frame at a top of the frame, wherein the battery pack is attached to the frame using a strap that has hook and loop fasteners in order to securely attach the battery pack to the frame.

* * * * *